US009050520B2

(12) United States Patent
Lu

(10) Patent No.: US 9,050,520 B2
(45) Date of Patent: Jun. 9, 2015

(54) BALL PITCHING MACHINE

(71) Applicant: Sheng-Hsiao Lu, Anding Township, Tainan County (TW)

(72) Inventor: Sheng-Hsiao Lu, Anding Township, Tainan County (TW)

( * ) Notice: Subject to any disclaimer, the term of this patent is extended or adjusted under 35 U.S.C. 154(b) by 253 days.

(21) Appl. No.: 13/845,227

(22) Filed: Mar. 18, 2013

(65) Prior Publication Data

US 2014/0261363 A1 Sep. 18, 2014

(51) Int. Cl.
*A63B 69/40* (2006.01)
*F41B 4/00* (2006.01)

(52) U.S. Cl.
CPC ..... *A63B 69/406* (2013.01); *F41B 4/00* (2013.01); *A63B 2069/402* (2013.01)

(58) Field of Classification Search
CPC .... A63B 69/406; A63B 2069/402; F41B 4/00
USPC ..... 124/78, 81, 6, 82; 473/422, 438, 451
See application file for complete search history.

(56) References Cited

U.S. PATENT DOCUMENTS

| | | | | | |
|---|---|---|---|---|---|
| 3,724,437 | A * | 4/1973 | Halstead | 124/78 |
| 4,026,261 | A * | 5/1977 | Paulson et al. | 124/78 |
| 4,193,591 | A * | 3/1980 | Paulson | 124/78 |
| 4,596,230 | A * | 6/1986 | Griffith | 124/78 |
| 4,632,088 | A * | 12/1986 | Bruce | 124/78 |
| 4,723,532 | A * | 2/1988 | Osojnak | 124/78 |
| 4,823,763 | A * | 4/1989 | Ponza | 124/78 |
| 4,841,945 | A * | 6/1989 | Braden | 124/78 |
| 4,922,885 | A * | 5/1990 | Iwabuchi et al. | 124/78 |
| 5,044,350 | A * | 9/1991 | Iwabuchi et al. | 124/51.1 |
| 5,125,653 | A * | 6/1992 | Kovacs et al. | 124/78 |
| 5,437,261 | A * | 8/1995 | Paulson et al. | 124/78 |
| 6,093,117 | A * | 7/2000 | Sherlock et al. | 473/422 |
| 6,164,271 | A * | 12/2000 | Paulson et al. | 124/78 |
| 6,488,020 | B1 * | 12/2002 | Rosas-Magallan | 124/78 |
| 6,880,542 | B1 * | 4/2005 | Johndreau et al. | 124/78 |
| 7,237,546 | B2 * | 7/2007 | Nozato | 124/78 |
| 7,553,244 | B2 * | 6/2009 | York | 473/438 |
| 7,691,012 | B2 * | 4/2010 | Cucjen et al. | 473/422 |
| 7,708,003 | B1 * | 5/2010 | Gavieres | 124/78 |
| 7,900,618 | B1 * | 3/2011 | Angermeier | 124/6 |
| 7,958,876 | B2 * | 6/2011 | Lay | 124/6 |
| 7,980,967 | B2 * | 7/2011 | Cucjen et al. | 473/422 |
| 8,074,633 | B2 * | 12/2011 | Grant et al. | 124/78 |
| 8,133,137 | B2 * | 3/2012 | Grant et al. | 473/451 |
| 8,287,404 | B2 * | 10/2012 | Cucjen et al. | 473/422 |
| 8,707,942 | B2 * | 4/2014 | Lu | 124/78 |
| 8,932,156 | B2 * | 1/2015 | Boehner | 473/438 |
| 2005/0072417 | A1 * | 4/2005 | Barron, Jr. | 124/78 |
| 2005/0103319 | A1 * | 5/2005 | Hudson et al. | 124/78 |

(Continued)

*Primary Examiner* — Melba Bumgarner
*Assistant Examiner* — Alexander Niconovich
(74) *Attorney, Agent, or Firm* — Alan D. Kamrath; Kamrath IP Lawfirm, P.A.

(57) ABSTRACT

A ball pitching machine includes a tripod, a mounting base, two rotary wheel devices, and a ball holder. The mounting base includes an engaging member rotatably mounted to a pillar of the tripod and a mounting plate pivotably coupled to the engaging member. The rotary wheel devices are mounted on two sides of the mounting plate and each includes a rotary wheel. The ball holder is mounted to the mounting plate and located between the rotary wheel devices. The ball holder of the ball pitching machine is applicable to different-sized rugby balls or soccer balls and can be easily adjusted to any elevation angle. The ball pitching machine allows elevation angles of the mounting base to be adjusted, and also allows elevation angles of the rotary wheels to be adjusted.

9 Claims, 11 Drawing Sheets

(56) References Cited

U.S. PATENT DOCUMENTS

2009/0095273 A1* 4/2009 Paulson et al. ..... 124/78
2012/0097145 A1* 4/2012 Lu ..... 124/78
2013/0087131 A1* 4/2013 Paulson et al. ..... 124/78
2013/0109510 A1* 5/2013 Boehner ..... 473/436
2013/0312723 A1* 11/2013 Lu ..... 124/7
2014/0261362 A1* 9/2014 Boehner ..... 124/78

* cited by examiner

BALL PITCHING MACHINE

BACKGROUND OF THE INVENTION

1. Field of the Invention

The present invention relates to a ball pitching machine and, more particularly, to a rugby or soccer ball pitching machine.

2. Description of the Related Art

Ball pitching machines which are designed for users who want to practice their skills of passing or catching rugby balls have been available in the market. A conventional rugby ball pitching machine includes two independent rotary wheels between which a rugby ball is held. When the rotary wheels are driven by a motor, the rugby ball held between the rotary wheels will be thrown by frictional force created by the contact of the rugby ball and the rotary wheels. However, the conventional rugby ball pitching machine with its rotary wheels exposed usually makes a user, who mistakenly touches the rotational rotary wheels, is prone to an incident. Moreover, the conventional rugby ball pitching machine is not freely adjusted to various elevation angles and directions for pitching. Further, the conventional rugby ball pitching machine is inapplicable to different-sized rugby balls.

BRIEF SUMMARY OF THE INVENTION

Thus, an objective of the present invention is to provide a ball pitching machine. The ball pitching machine features its safety and serviceability for different-sized rugby or soccer balls. Furthermore, the ball pitching machine of the present invention allows its rotary wheels to be conveniently adjusted between different elevation angles by which a ball's placement can be precisely decided. Furthermore, the ball pitching machine of the present invention enables a ball to fly along a high parabolic trajectory or a curved trajectory or to roll on the ground by easy adjustment.

To achieve this and other objectives, a ball pitching machine of the present invention includes a tripod, a mounting base, two rotary wheel devices, and a ball holder. The tripod includes a pillar. The mounting base includes an engaging member and a mounting plate. The engaging member is rotatably mounted to the pillar. A horizontal axle is engaged on the engaging member. The mounting plate is pivotably coupled to the horizontal axle. The rotary wheel devices are mounted on two sides of the mounting plate and spaced from each other in a horizontal direction. Each rotary wheel device includes a joint lever and a base plate. Each joint lever includes a top end and a lower end. Each base plate includes an inner end portion and an outer end portion. The lower ends of the joint levers are movably mounted on the two sides of the mounting plate in the horizontal direction. Each rotary wheel device further includes a rotary wheel mounted on the inner end portion of each base plate. The outer end portion of each base plate is pivotably engaged with one of the top ends of the joint levers. Each rotary wheel device further includes a cover covering an associated rotary wheel. The ball holder includes a strut bar, two holding plates, and a holding unit. The strut bar includes a front end connected to the mounting plate and located between the rotary wheel devices. The two holding plates are engaged on the strut bar and movable relative to the strut bar in the horizontal direction, with a space formed between the two holding plates for accommodating a rugby ball or a soccer ball. A connecting sheet is engaged to each holding plate and connected to the lower end of one of the joint levers to allow joint movement of the holding plates and the joint levers in the horizontal direction. The holding unit is movably installed on the strut bar and located behind the two holding plates. The holding unit includes a movable seat, a handgrip mounted on the movable seat, and a holding member mounted on a front end of the handgrip. The movable seat is movable relative to the two holding plates. The holding member includes a front portion for holding or abutting the rear portion of the rugby ball.

In a preferred form, each rotary wheel has bevels on upper and lower edges thereof. The strut bar further includes a connecting piece fixed at the front end of the strut bar, and the holding plates are respectively engaged on two ends of the connecting piece. A horizontal bolt is connected with upper ends of the holding plates.

In a preferred form, the mounting plate includes an upper portion and a mounting portion extending downward from the upper portion. The lower ends of the joint levers are movably fixed on two sides of the mounting portion of the mounting plate. A plurality of grooves is formed in two sides of the mounting portion. The joint levers are movable relative to the mounting plate to adjust the fixed position by extending a plurality of joint pieces through the grooves of the mounting plate and the lower ends of the joint levers. The front end of the strut bar is connected to the upper portion of the mounting plate.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
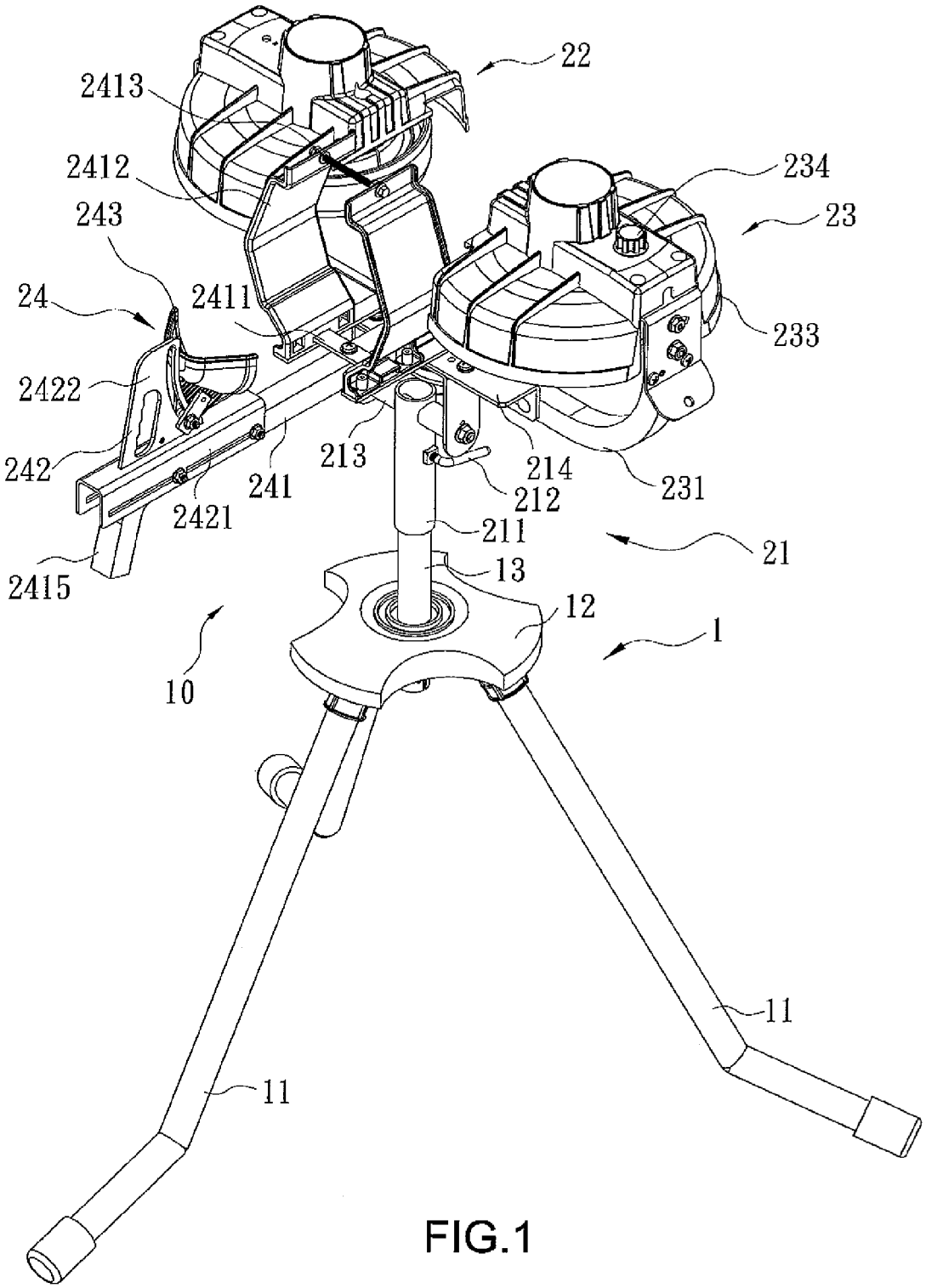
FIG. 1 is perspective view of a ball pitching machine according to the present invention.
Figure 2:
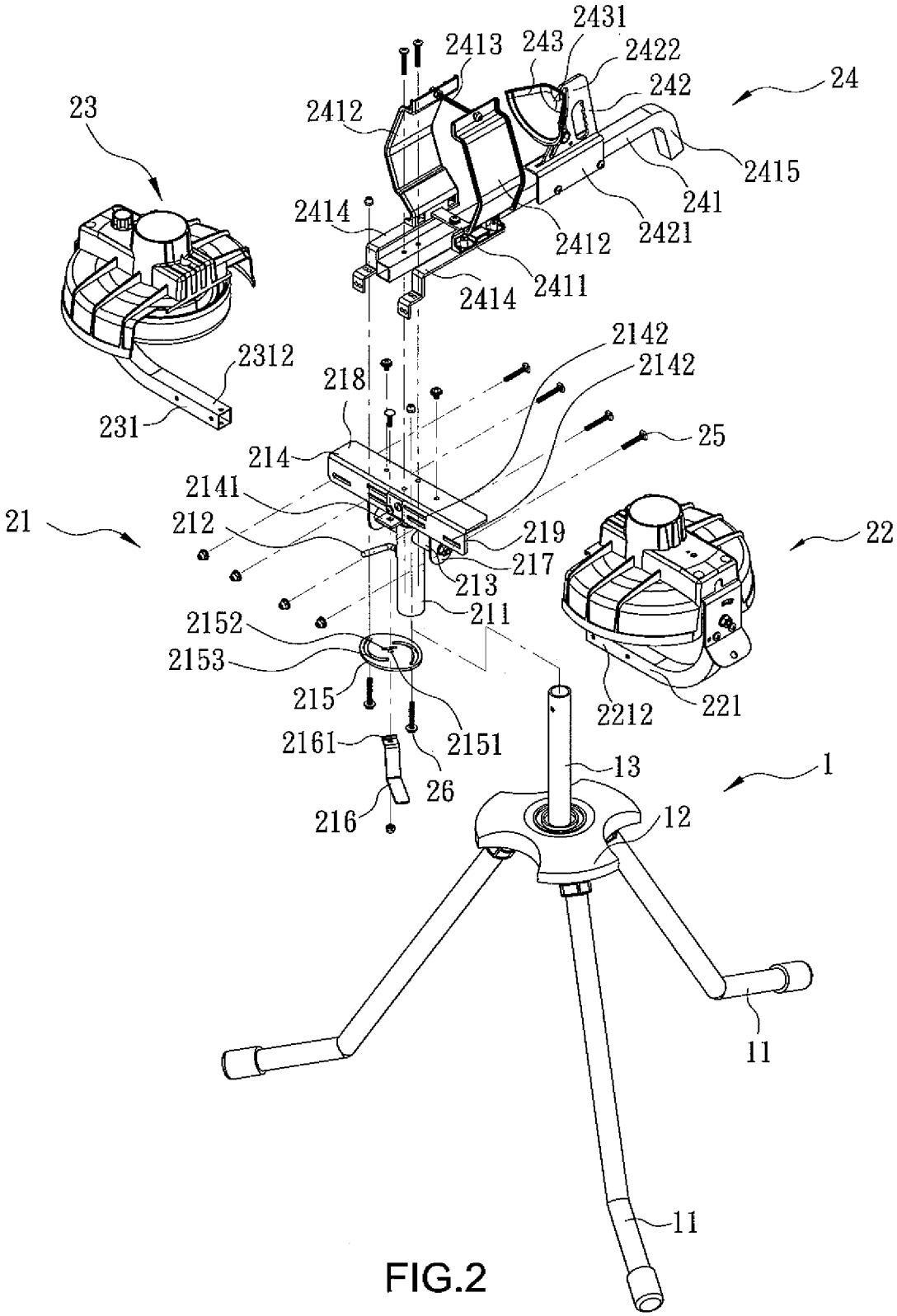
FIG. 2 is an exploded, perspective view of the ball pitching machine of FIG. 1.

With reference to FIGS. 1 through 11, a ball pitching machine 10 according to the present invention generally includes a stand or tripod 1, a mounting base 21, two rotary wheel devices 22 and 23, and a ball holder 24. The tripod 1 includes a plurality of legs 11, a support plate 12 engaged on upper ends of the legs 11, and a pillar 13 mounted to the support plate 12. In an embodiment, a length of pillar 13 is adjustable.

The mounting base 21 includes a tubular engaging member 211 and an L-shaped mounting plate 214. The engaging member 211 is rotatably mounted around the pillar 13. A positioning piece 212 includes an inner end extending into the engaging member 211 and abutting against an outer wall of the pillar 13, so that the engaging member 211 is releasably combined with the pillar 13. A horizontal axle 213 extends through and engaged on an upper end of the engaging member 211 with two ends of the horizontal axle 213 located outside of two sides of the engaging member 211. The L-shaped mounting plate 214 includes a horizontal upper portion 218 and a vertical mounting portion 219 bended downward from the horizontal upper portion 218. Two junction plates 217 respectively extend downward from a bottom face of the horizontal upper portion 218 and are coupled to the two ends of the horizontal axle 213, so that the mounting plate 214 is pivotably coupled to the horizontal axle 213. A plurality of grooves 2142 is formed in two sides of the mounting portion 219, and an engaging piece 2141 is provided on a middle portion between the two sides of the mounting portion 219 (see FIG. 2). A turntable 215 is engaged on a bottom of the engaging piece 2141 via a connector (not labeled) through a through-hole 2151 in a center of the turntable 215. The turntable 215 includes a connection slot 2152 and two arcuate grooves 2153 surrounding the through-hole 2151 and opposite to each other. An inner end of a handle 216 is connected to the turntable 215 and the engaging piece 2141 by a connector (not labeled) and is provided with a connecting portion 2161 inserted into the connection slot 2152, allowing the turntable 215 to be turned during swing of the handle 216.

Figure 3:
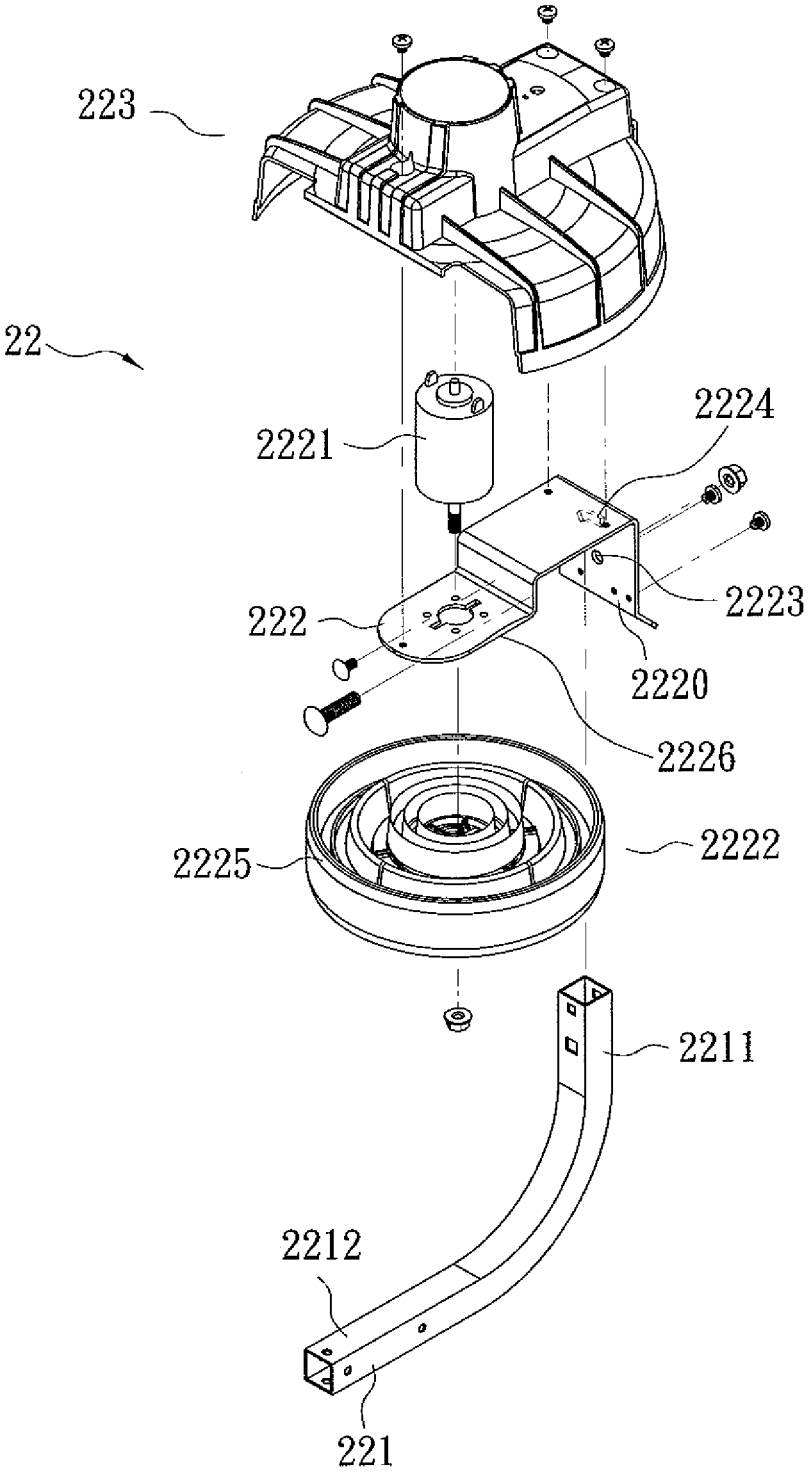
FIG. 3 is an exploded, perspective view of a rotary wheel device of the ball pitching machine of FIG. 2.
Figure 4:
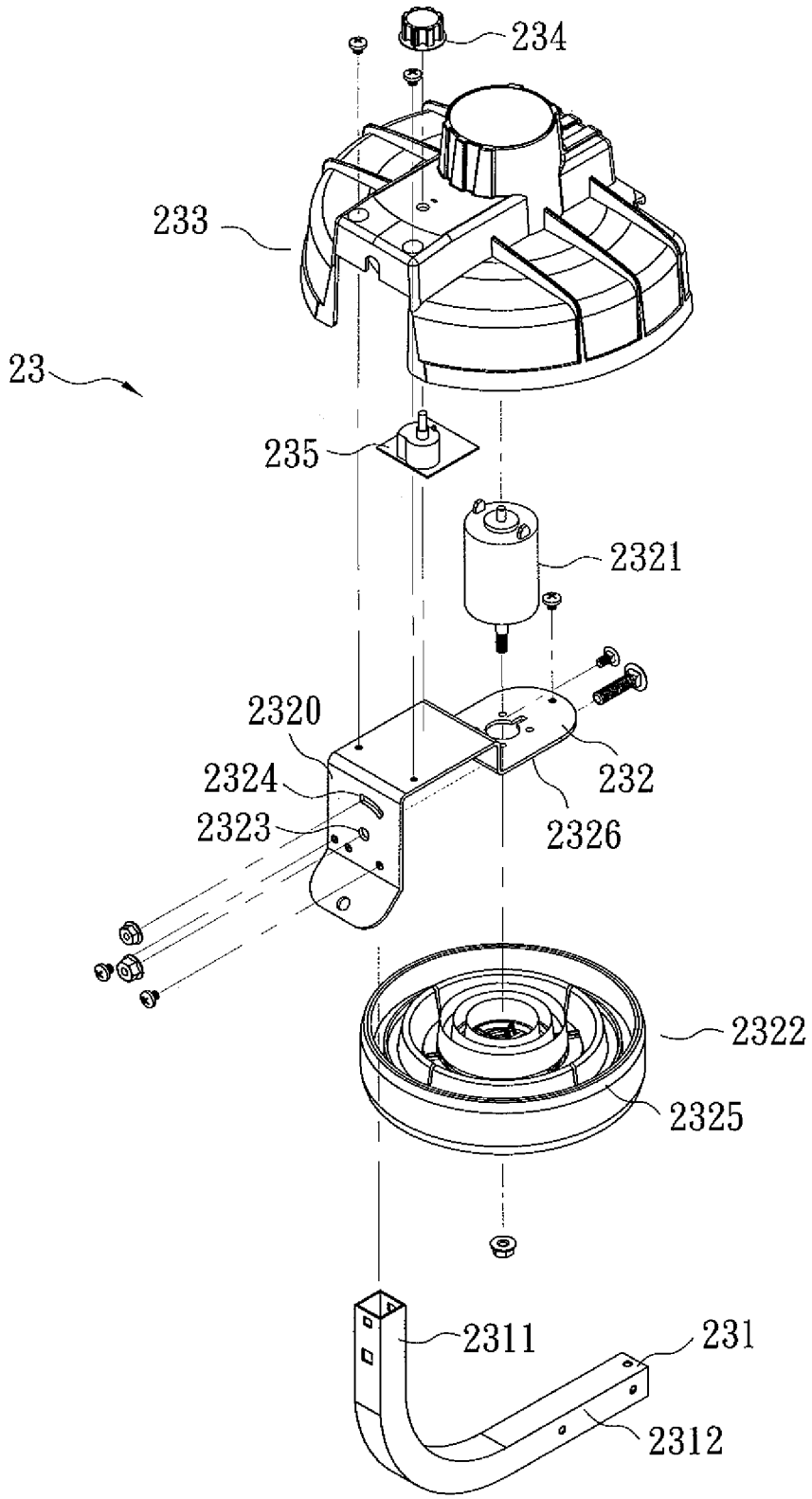
FIG. 4 is an exploded, perspective view of another rotary wheel device of the ball pitching machine of FIG. 2.
Figure 5:
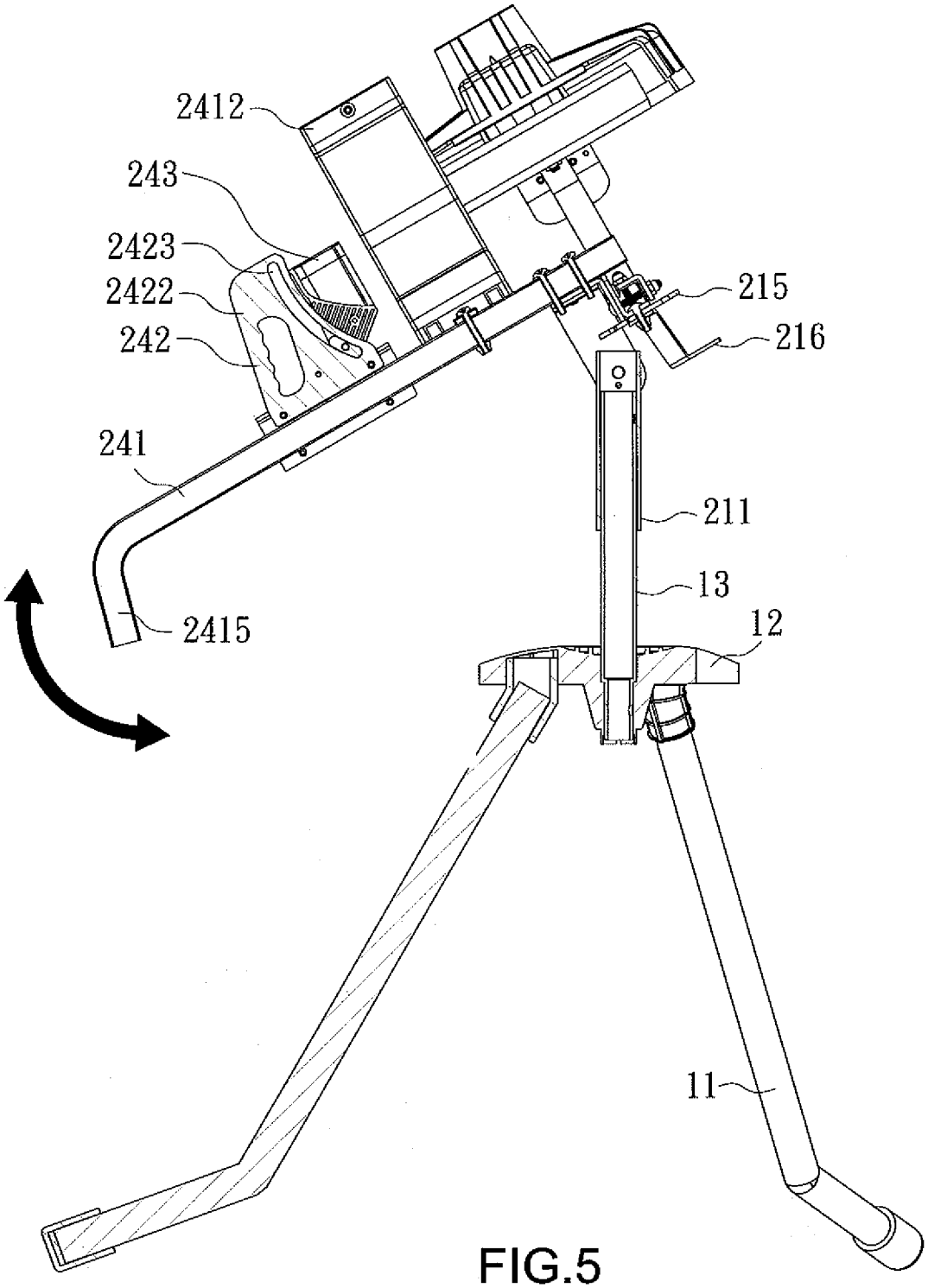
FIG. 5 is a side view of the ball pitching machine of FIG. 1.
Figure 6:
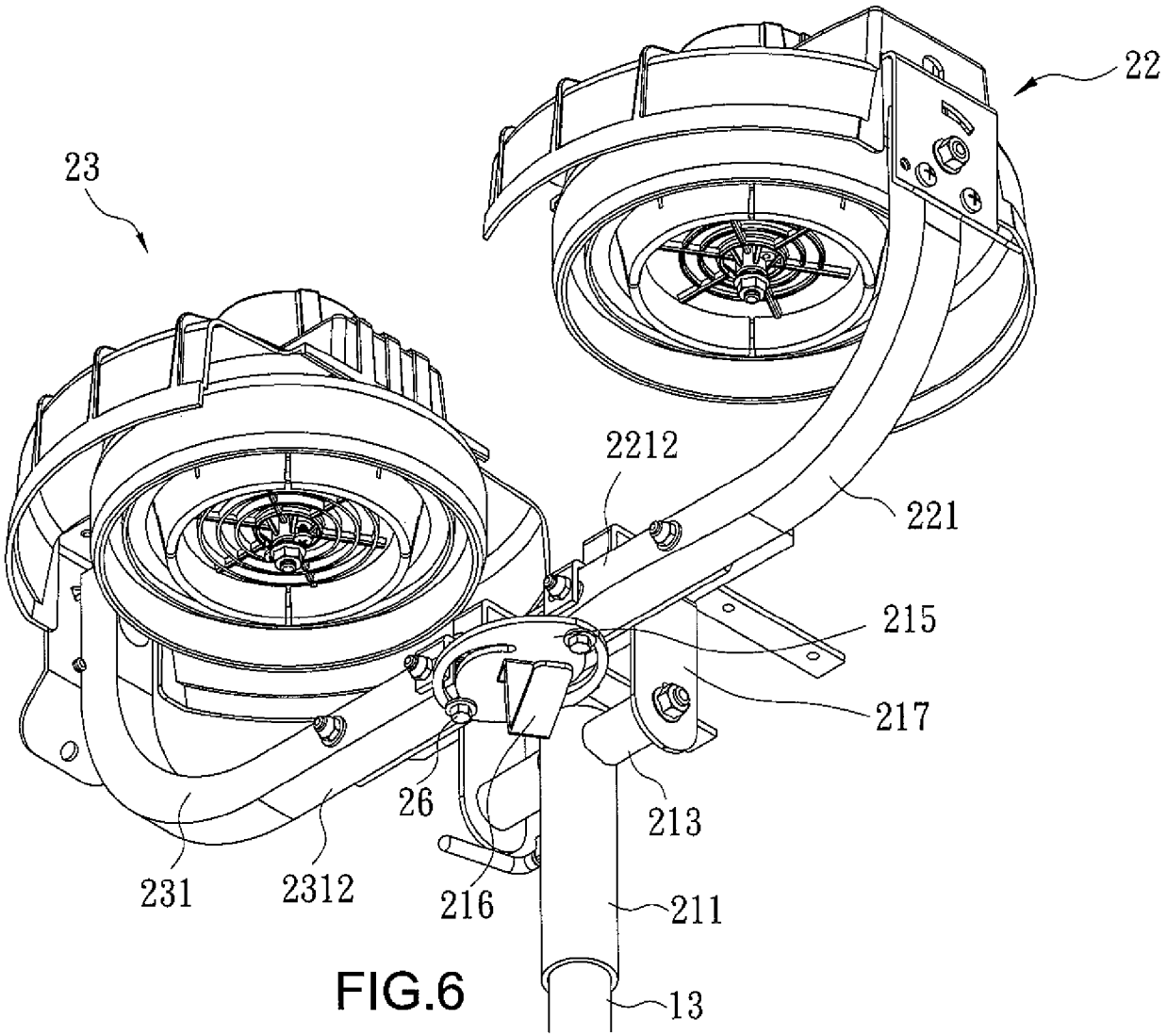
FIG. 6 is a partial, schematic view of the ball pitching machine of FIG. 1.
Figure 7:
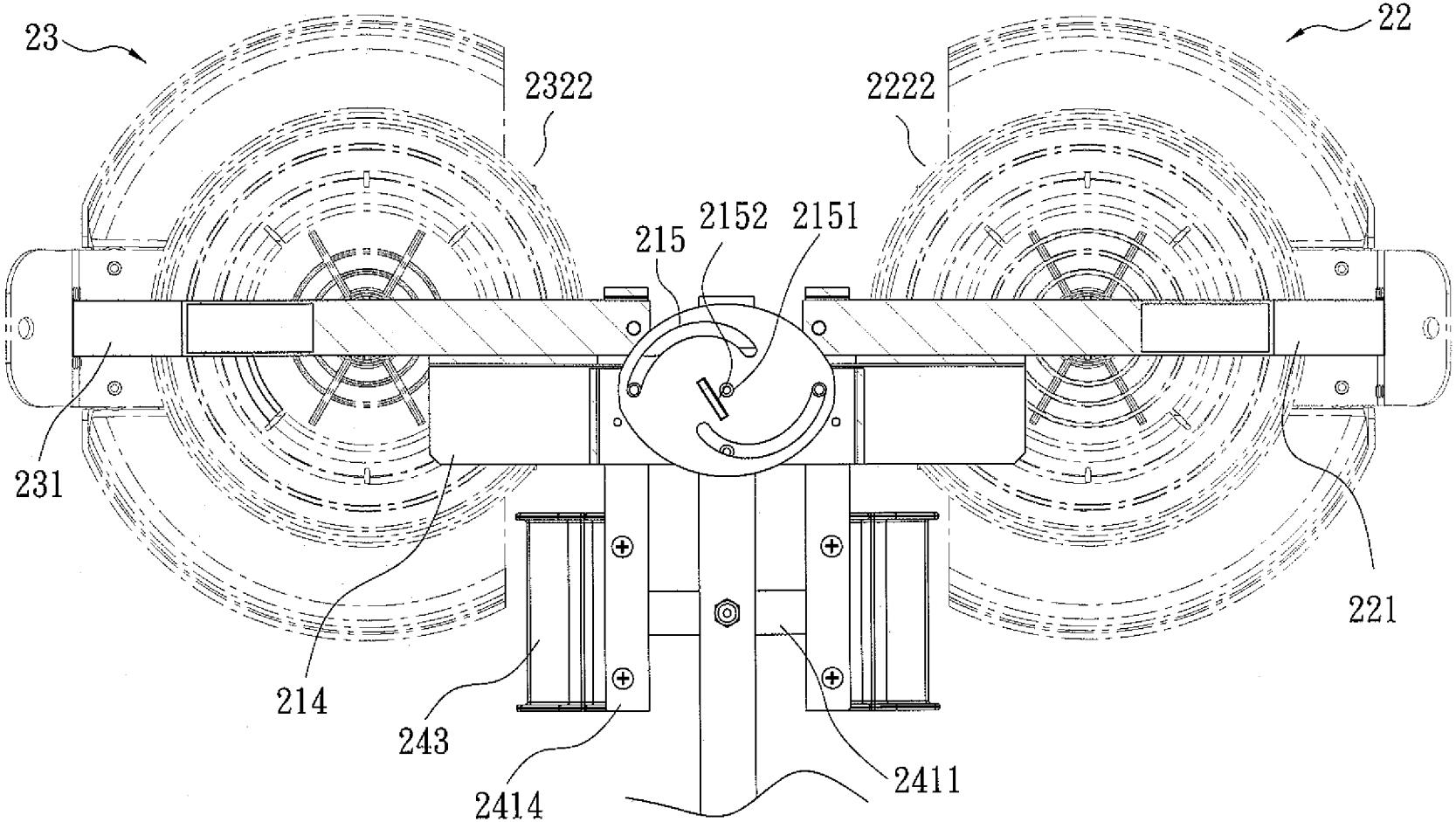
FIG. 7 is a schematic sectional view of the ball pitching machine of FIG. 6.
Figure 8:
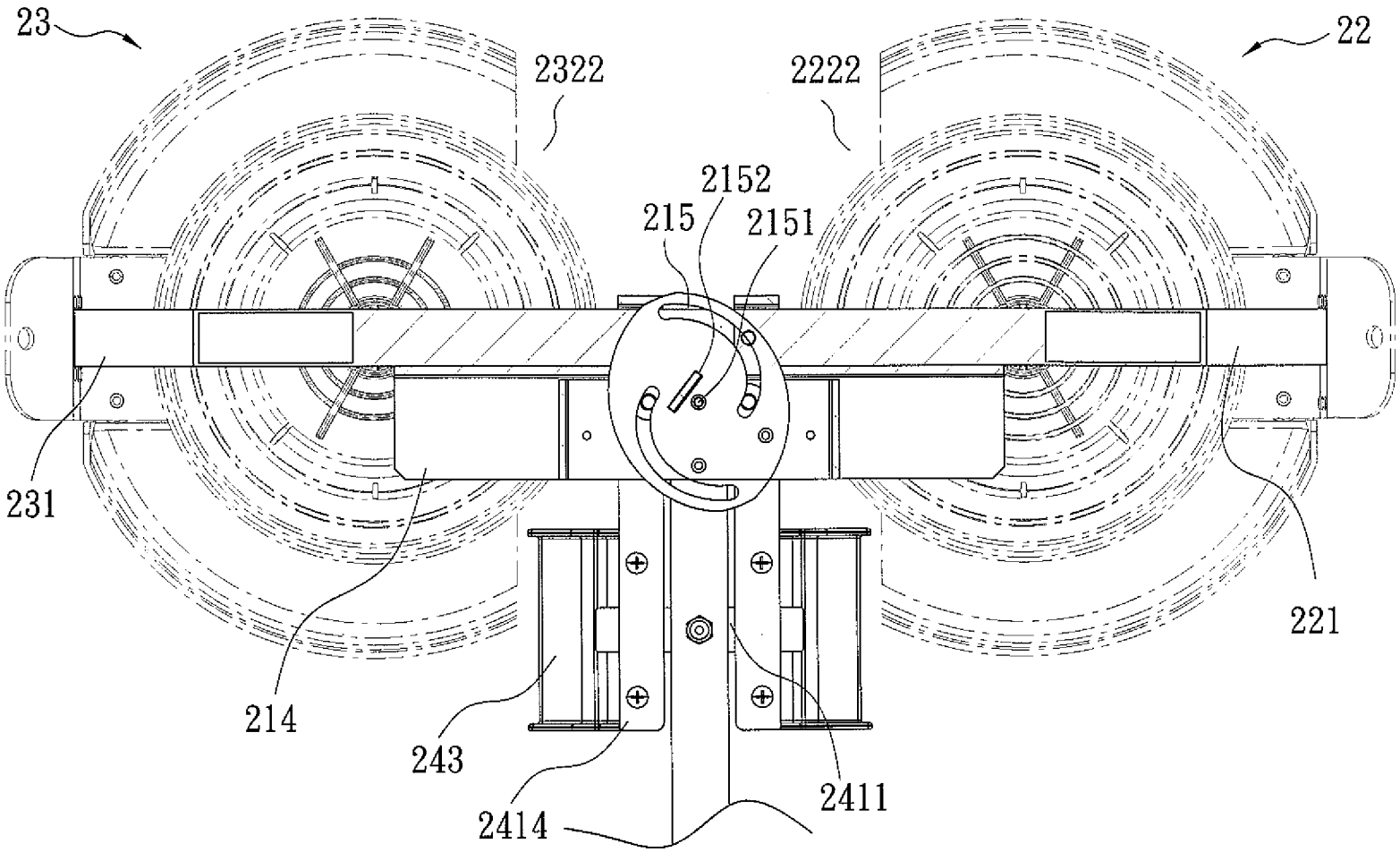
FIG. 8 shows a view similar to FIG. 7, illustrating an adjustable spacing between the two rotary wheel devices of the ball pitching machine in FIG. 7.
Figure 9:
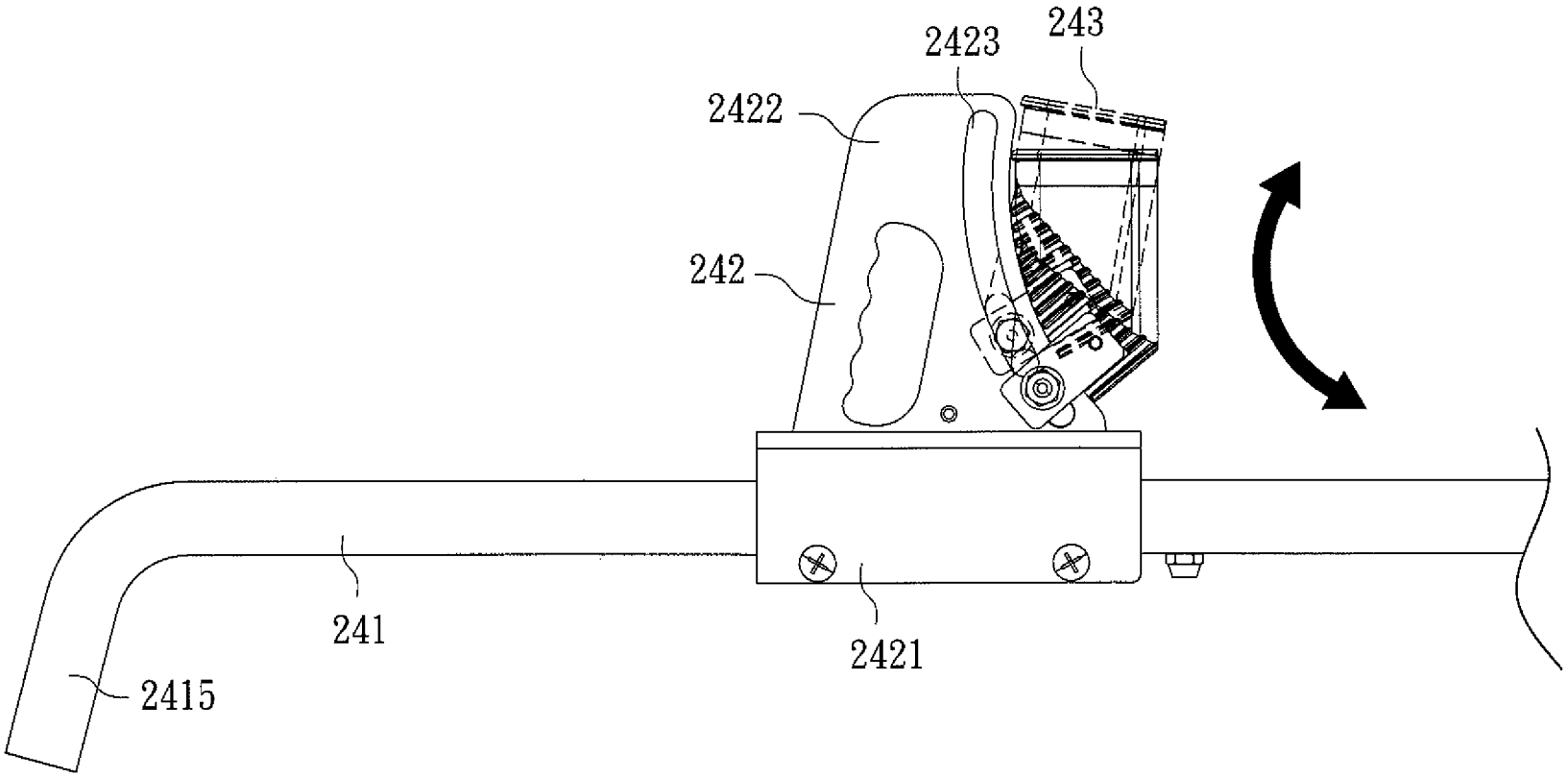
FIG. 9 is a side view of a ball holder of the ball pitching machine of FIG. 1.

The rotary wheel devices 22 and 23 respectively include an L-shaped joint lever 221, 231 and a base plate 222, 232. Each of the joint levers 221 and 231 includes a top end 2211, 2311 and a lower end 2212, 2312. The lower ends 2212 and 2312 of the joint levers 221 and 231 are spaced from each other in a horizontal direction and are mounted on two sides of the mounting portion 219 of the mounting plate 214. The joint levers 221 and 231 are movable relative to the mounting plate 214 to adjust the fixed position by extending a plurality of joint pieces 25 through the grooves 2142 of the mounting plate 214 and the lower ends 2212 and 2312 of the joint levers 221 and 231. Moreover, rotation of the turntable 215 enables movement of the joint levers 221 and 231 relative to the mounting plate 214 by extending two joint pieces 26 through the arcuate grooves 2153 and the lower ends 2212 and 2312 of the joint levers 221 and 231. With reference to FIGS. 3 and 4, the base plates 222 and 232 respectively include an inner end portion 2226, 2326 and an outer end portion 2220, 2320. Motors 2221 and 2321 and rotary wheels 2222 and 2322 are respectively mounted on the inner end portions 2226 and 2326 of the base plates 222 and 232. Upper and lower circumferential edges of the rotary wheels 2222 and 2322 are respectively formed with bevels 2225, 2325 which avoid cutting or wearing a rugby ball by the rotary wheels 2222 and 2322 during rapid rotation of the rotary wheels 2222 and 2322. The outer end portions 2220 and 2320 of the base plates 222 and 232 are respectively provided with a pin hole 2223, 2323 and a guide slot 2224, 2324. The outer end portions 2220 and 2320 of the base plates 222 and 232 are respectively engaged with the top ends 2211 and 2311 of the joint levers 221 and 231 by extending joint pieces (not labeled) through the pin holes 2223 and 2323 and the guide slots 2224 and 2324 into the top ends 2211 and 2311 of the joint levers 221 and 231, so that the base plates 222 and 232 can be respectively pivoted about the pin holes 2223 and 2323 of the joint levers 221 and 231 for angular adjustment. Each of the rotary wheel devices 22 and 23 further includes a cover 223, 233 respectively mounted to the base plates 222 and 232 and covering and protecting the motors 2221 and 2321 and the rotary wheels 2222 and 2322. Furthermore, the cover 233 is provided with a switch 234 and an electronic circuit component 235 which is electrically connected to the switch 234 and the motors 2221 and 2321, so that the switch 234 enables/disables the motors 2221 and 2321 and controls the rotational speed of the motors 2221 and 2321.

Figure 10:
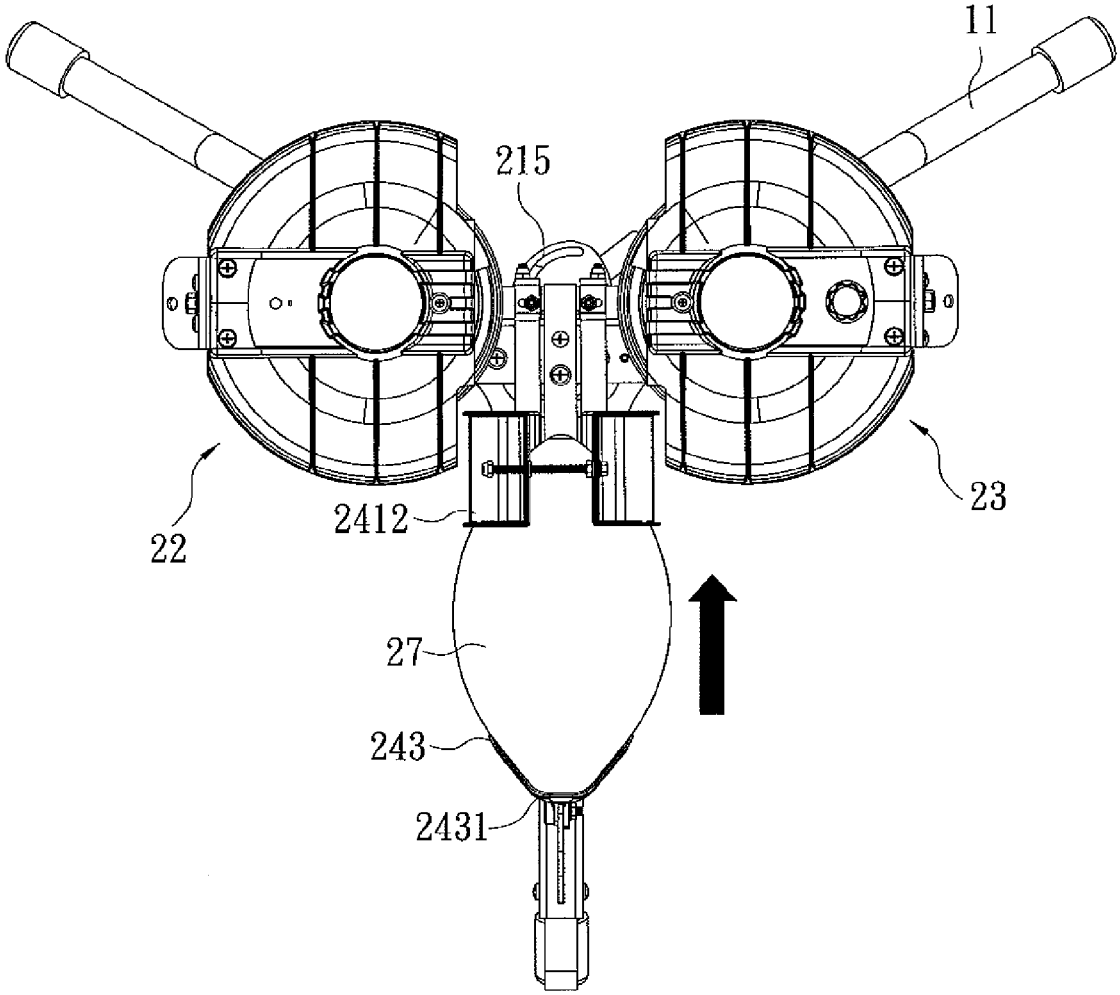
FIG. 10 is a top view of the ball pitching machine of FIG. 1, with a rugby ball placed on the ball pitching machine.
Figure 11:
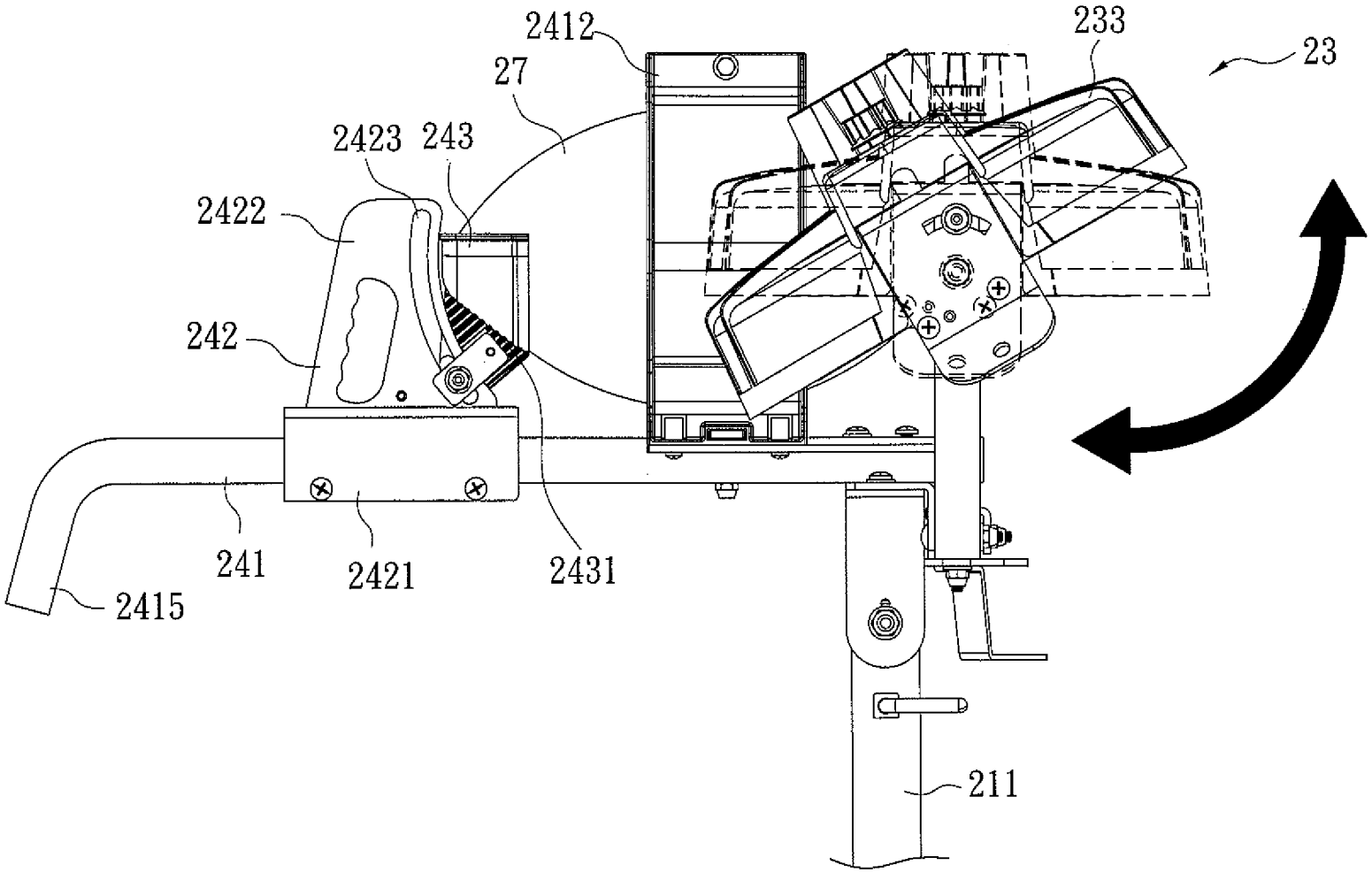
FIG. 11 is a partial side view of the ball pitching machine of FIG. 10, with one of the rotary wheel devices adjusted to an elevation angle.

The ball holder 24 includes a strut bar 241, two holding plates 2412, and a holding unit 242. The strut bar 241 includes a front end connected to a top surface of the upper portion 218 of the mounting plate 214 and situated between the two rotary wheel devices 22 and 23 in the horizontal direction. The strut bar 241 further includes a connecting piece 2411 fixed at the front end of the strut bar 241 and a gripping portion 2415 formed at a rear end of the strut bar 241. The holding plates 2412 are respectively engaged on two ends of the connecting piece 2411 and movable relative to the connecting piece 2411 in the horizontal direction. The bolding plates 2412 are spaced from each other in the horizontal direction, and a space is formed between the holding plates 2412 for accommodating a rugby ball 27 or a soccer ball (FIGS. 10 and 11). A connecting sheet 2414 is engaged on a lower end of each holding plate 2412 and connected to the lower end 2212, 2312 of one of the joint levers 221 and 231, allowing joint movement of the holding plates 2412 and the joint levers 221 and 231 for a changed spacing between the holding plates 2412 in the horizontal direction. A connecting member 2413, such as a horizontal bolt, is connected with upper ends of the holding plates 2412, preventing a larger rugby ball from entering the holding space in the ball holder 24 when a spacing between the holding plates 2412 has not been properly adjusted. The holding unit 242 is movably installed on the strut bar 241 and located behind the holding plates 2412. The holding unit 242 includes a movable seat 2421, a handgrip 2422 mounted on the movable seat 2421, and a holding member 243 mounted on a front end of the handgrip 2422. The movable seat 2421 is movable relative to the holding plates 2412. The handgrip 2422 includes an arcuate guide slot 2423 in which a rear portion of the holding member 243 is engaged, so that the holding member 243 is movable along the guide slot 2423 for adjusting angles of the holding member 243 relative to the holding plates 2412. The holding member 243 includes a front portion 2431 for holding or abutting the rear portion of the rugby ball 27.

In operation, a height or an angle of the mounting base 21 relative to the tripod 1 can be regulated through the engaging member 211, and an elevation angle of the mounting plate 214 relative to the horizontal axle 213 is adjustable to allow the rotary wheel devices 22 and 23 and the ball holder 24 to be horizontal or upward or downward inclined. That is, an upward or downward inclination of the rotary wheel device 22, 23 or the ball holder 24 for a rugby ball to be thrown can be set. As an example, a high toss ball will be created when the rotary wheel devices 22 and 23 are in an upward inclination. Moreover, the handle 216 operated by one user is able to revolve the turntable 215, shifting the rotary wheel devices 22 and 23 and the connecting sheets 2414, and, thus, adjusting the spacing between the rotary wheels 2222 and 2322 and the spacing between the two holding plates 2412 to accommodate different-sized rugby balls 27. In addition, after the rugby ball 27 is held between the holding plates 2412, the movable seat 2421 can be moved toward the rugby ball 27, catching the rear side of the rugby ball 27 by the front portion 2431 of the holding member 243. Furthermore, the position of the holding member 243 relative to the holding plates 2412 can be adjusted, so that the rear side of the rugby ball 27 can be exactly caught by the front portion 2431 of the holding member 243 (see FIGS. 9 and 10). After the height and the elevation angle for toss is adjusted, the rotary wheels 2222 and 2322 driven by the motors 2221 and 2321 are able to throw the rugby ball 27 by friction between the rotary wheels 2222 and 2322 and the rugby ball 27.

FIG. 11 illustrates the ball pitching machine 10 of the present invention throwing a curve ball. Specifically, the rotary wheel device 23 can be adjusted to an elevation angle when the base plate 232 is moved relative to the joint lever 231 with the joint piece held in the pin hole 2323 of the joint lever 231 taken as one fulcrum. As such, a revolving curve ball is thrown by the ball pitching machine 10 of the present invention with the rotary wheel device 23 tilted upward and the rotary wheel device 22 kept horizontal.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ball pitching machine, comprising:

a tripod including a pillar;

a mounting base including an engaging member and a mounting plate, with the engaging member rotatably mounted to the pillar, with a horizontal axle engaged on the engaging member, with the mounting plate pivotably coupled to the horizontal axle;

two rotary wheel devices mounted on two sides of the mounting plate and spaced from each other in a horizontal direction, with the two rotary wheel devices including two joint levers and two base plates, with each of the two joint levers including a top end and a lower end, with the lower ends of the two joint levers independently movably mounted on the two sides of the mounting plate in the horizontal direction, with the lower ends of the two joint levers being moveable relative to each other in the horizontal direction, with each of the two base plates of the two rotary wheel devices including an inner end portion and an outer end portion, with a rotary wheel mounted on the inner end portion of each base plate, with the outer end portion of each base plate pivotably engaged with one of the top ends of the two joint levers, with each of the two rotary wheel devices further including a cover for covering an associated rotary wheel; and a ball holder including a strut bar, two holding plates, and a holding unit, with the strut bar including a front end connected to the mounting plate and located between the two rotary wheel devices, with the two holding plates engaged on the strut bar and both being movable relative to the strut bar in the horizontal direction, with the two holding plates being moveable relative to each other in the horizontal direction, with a space formed between the two holding plates for accommodating a rugby ball or a soccer ball, with two connecting sheets engaged to the two holding plates and connected to the lower ends of the two joint levers to allow joint movement of the two holding plates and the two joint levers, respectively, with the holding unit movably installed on the strut bar and located behind the two holding plates, with the holding unit including a movable seat, a handgrip mounted on the movable seat, and a holding member mounted on a front end of the handgrip, with the movable seat being movable relative to the two holding plates, with the holding member including a front portion for holding or obliging a rear portion of the rugby ball.

2. The ball pitching machine according to claim 1, with the mounting plate including an upper portion and a mounting portion extending downward from the upper portion, with the lower ends of the two joint levers adjustably fixed on two sides of the mounting portion of the mounting plate, with the front end of the strut bar connected to the upper portion of the mounting plate.

3. The ball pitching machine according to claim 2, with a connecting piece extending in the horizontal direction and fixed at the front end of the strut bar, with the two holding plates respectively engaged on two ends of the connecting piece, with a horizontal bolt extending in the horizontal direction and connected with upper ends of the two holding plates spaced from the strut and parallel to the connecting piece.

4. The ball pitching machine according to claim 2, with a plurality of grooves formed in two sides of the mounting portion, with the two joint levers being movable in the horizontal direction relative to the mounting plate by extending a plurality of joint pieces through the plurality of grooves of the mounting portion of the mounting plate and the lower ends of the two joint levers.

5. The ball pitching machine according to claim 2, with an engaging piece provided on a middle portion between the two sides of the mounting portion, with a turntable engaged on the engaging piece and including two arcuate grooves opposite to each other, with rotation of the turntable moving the two joint levers relative to the mounting plate in the horizontal direction by extending two joint pieces through the arcuate grooves in the turntable and the lower ends of the two joint levers.

6. The ball pitching machine according to claim 2, with the outer end portions of the two base plates respectively provided with a pin hole and a guide slot, with the top ends of the two joint levers respectively engaged with the outer end portions of the two base plates by extending joint pieces through the pin holes and the guide slots of the two base plates into the top ends of the two joint levers.

7. The ball pitching machine according to claim 2, with the horizontal axle including two ends located outside of two sides of the engaging member, with two junction plates located outside of the two sides of the engaging member and extending downward from a bottom face of the upper portion of the mounting plate and coupled to the two ends of the horizontal axle respectively.

8. The ball pitching machine according to claim 2, with the handgrip including an arcuate guide slot, with the holding member including a rear portion engaged in the guide slot of the handgrip, with the holding member being movable along the guide slot.

9. The ball pitching machine according to claim 2, with each of the two rotary wheels having bevels on upper and lower edges thereof.

* * * * *